United States Patent [19]

Thornton et al.

[11] 4,412,200

[45] Oct. 25, 1983

[54] VARIABLE INDUCTOR WITH CARRIAGE FOR MULTIPLE TROLLEY WHEELS

[75] Inventors: Jack C. Thornton, Satellite Beach, Fla.; Randy G. Russell, Arlington Heights, Ill.

[73] Assignee: Rockwell International Corporation, El Segundo, Calif.

[21] Appl. No.: 364,291

[22] Filed: Apr. 1, 1982

[51] Int. Cl.[3] ..... H01F 29/06

[52] U.S. Cl. ..... 336/139; 336/137; 336/140; 336/141; 336/144; 336/149

[58] Field of Search ..... 336/139, 137, 140, 141, 336/144, 149

[56] References Cited

U.S. PATENT DOCUMENTS 2,331,522 10/1943 Vance ..... 336/140 X 2,415,736 2/1947 Flood et al. ..... 336/140 X 3,156,888 11/1964 Blanco ..... 336/139 X 4,064,474 12/1977 Adams et al. ..... 336/139

*Primary Examiner*—A. T. Grimley

*Assistant Examiner*—Susan Steward

*Attorney, Agent, or Firm*—Terry M. Blackwood; Howard R. Greenberg; H. Fredrick Hamann

[57] ABSTRACT

As part of a moveable carriage assembly, a plurality of trolley wheels are capable of being driven, in worm-gear fashion, along a coil which is rotatable about its axis. One end of the coil is conductive and the other end of the coil is preferably non-conductive. A further part of the traveling carriage assembly electrically interconnects a conductive trolley wheel with an electrical contact situated remote from one end of the coil. Multiple conductive wheels are electrically interconnected.

5 Claims, 6 Drawing Figures

VARIABLE INDUCTOR WITH CARRIAGE FOR MULTIPLE TROLLEY WHEELS

The present invention is generally related to variable inductance apparatus and more specifically to radio frequency or other high voltage tuneable coils.

One common variable inductance coil is the conventional and well-known roller or rotary coil. The roller coil comprises a roller or trolley wheel contactor on an electrically conductive guide or bar which runs the entire length of the coil. Since the guide or bar is electrically connected to one end of the used portion of the coil, the voltage across the used portion of the coil is limited to the breakdown voltage of the gap between the high voltage end of the used coil portion and the conductive guide or bar.

Additionally, these and other existing high inductance coils are often restricted in the frequency range over which they are useable. Such restriction is due to the unused portion of the coil or solenoid going resonant at certain frequencies and causing a power loss in the active circuit. The high currents generated in the resonant unused portion of the coil dissipate power and such dissipated power represents power that is not going to the load. Therefore, the load power drops off as the unused coil portion goes resonant. In addition, high voltages and currents are generated in the unused coil portion and these can damage the coil assembly due to voltage breakdown or excessive current heating. One prior art solution is to stop using the coil at some frequency and break up the unused portion resonances by putting multiple shorts onto and across appropriate sections of the unused coil portion. Quick connection shorting means (employing, for example, alligator clips) are typical of one approach. A somewhat more mechanized prior art approach has been to connect a plurality of wires to turns of the coil at various coil positions and to run all of these wires to one or more shorting switches.

Yet another prior art approach is shown in U.S. Pat. No. 3,958,196 assigned to the assignee of the present invention. Said patent shows a variable inductor having a non-rotating coil along with a sliding flexible conductive ribbon for shorting out selected turns of the coil. The tuning and shorting are stepped rather than continuous, the smallest tuning increment being one whole turn.

In accordance with the present invention, these problems are addressed and resolved by variable inductance apparatus which includes a carriage means, such apparatus (i) providing an electrical connection which is moveable along with a moveable contactor, (ii) capable of providing multiple moveable contactors each capable of continuously contacting the electrical coil, and (iii) capable of providing a mechanical storage or memory system for preserving the relative position of the contactors when they are not needed for a particular tuning condition. These and other features, objects, and advantages of the invention will become more apparent upon reference to the following specification, claims, and appended drawings in which:

Figure 2:
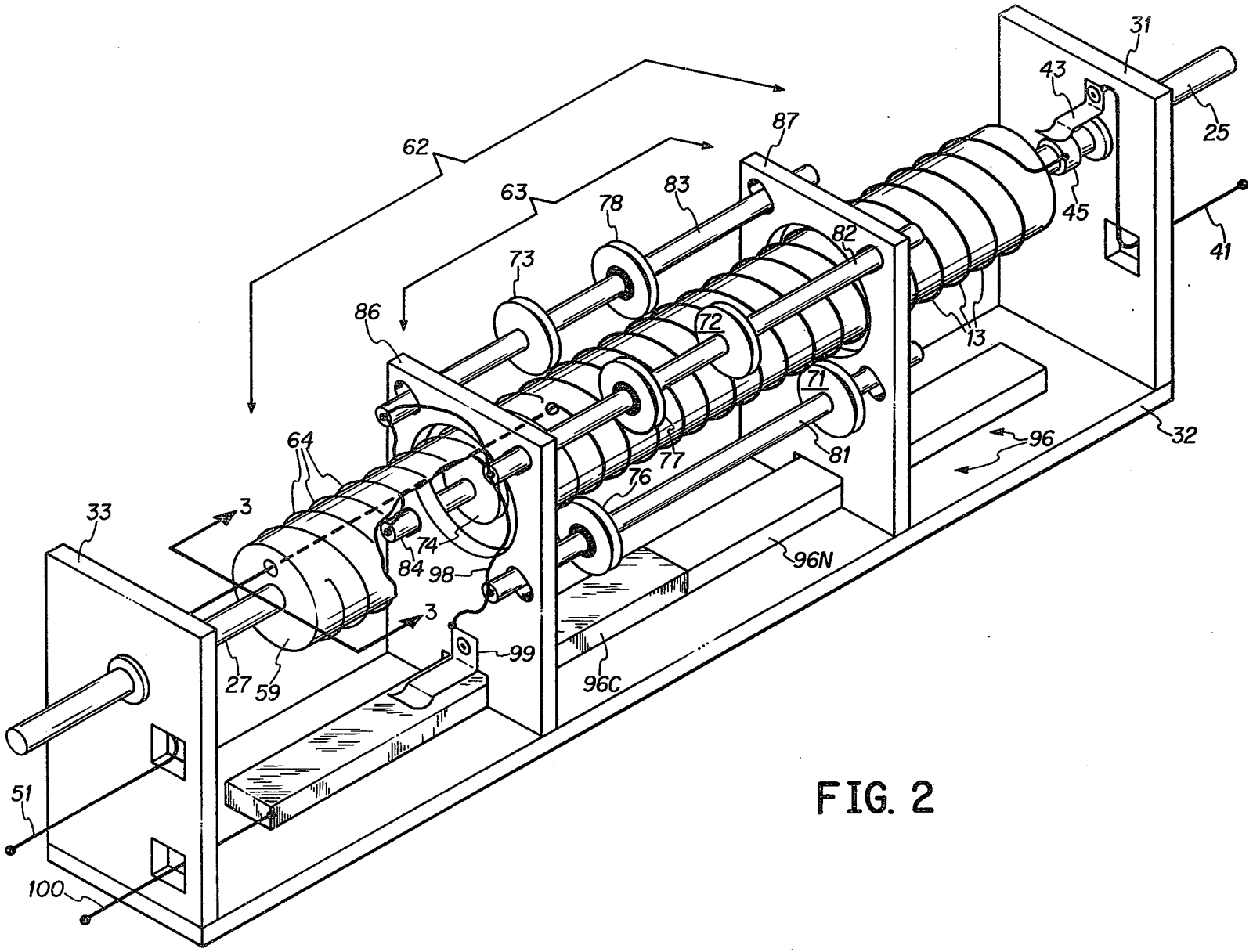
FIG. 2 is an exploded perspective view representing variable inductor apparatus incorporating the principles of the present invention.
Figure 3:
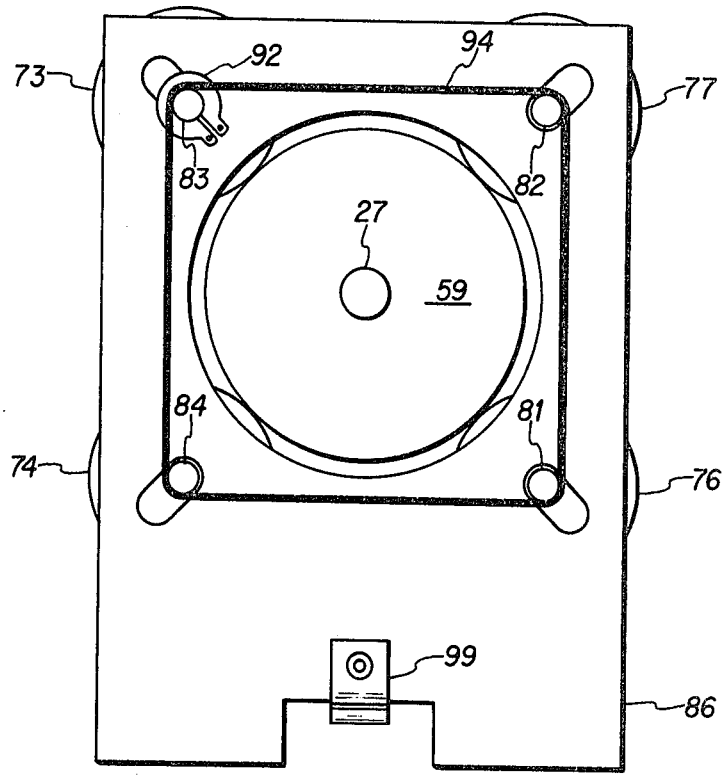
Figure 4A:
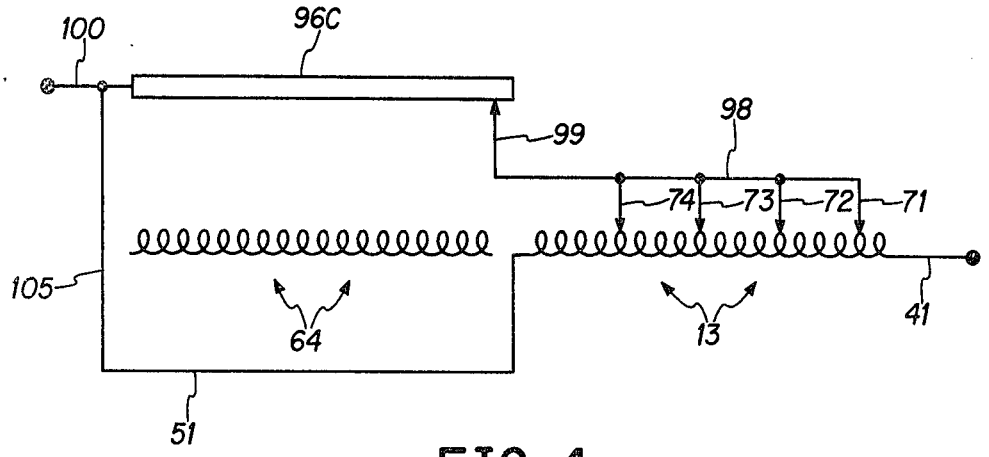
Figure 4B:
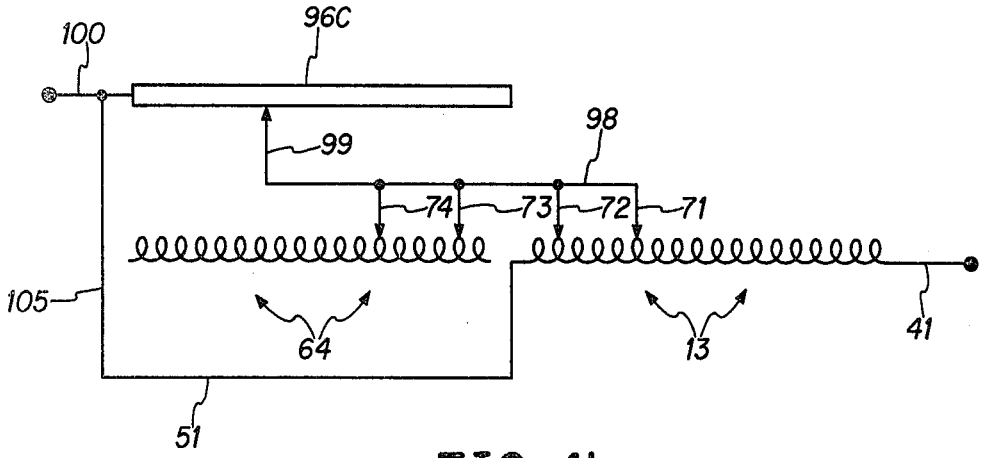
Figure 4C:
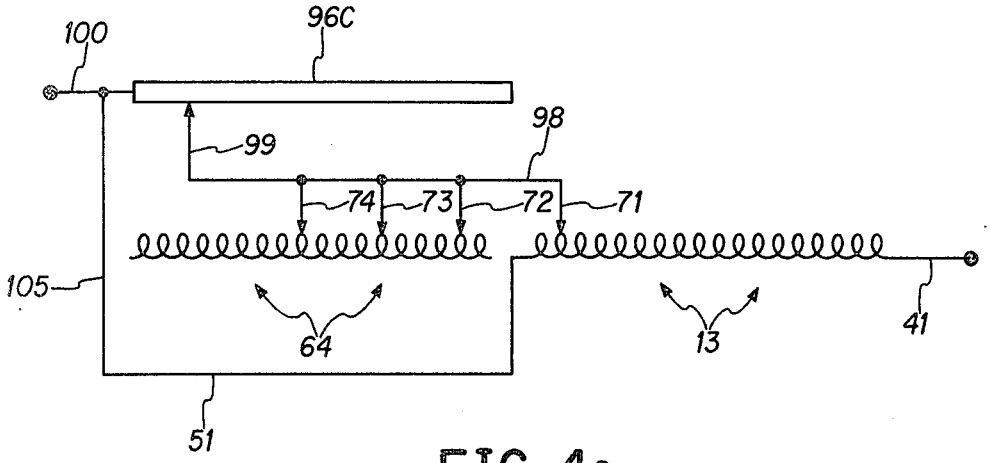

FIG. 3 is an end view of the FIG. 2 apparatus with plate 33 and base 32 removed; and FIGS. 4*a*, 4*b*, and 4*c* are schematics representing the FIG. 2 apparatus in different tuning conditions.

Figure 1:
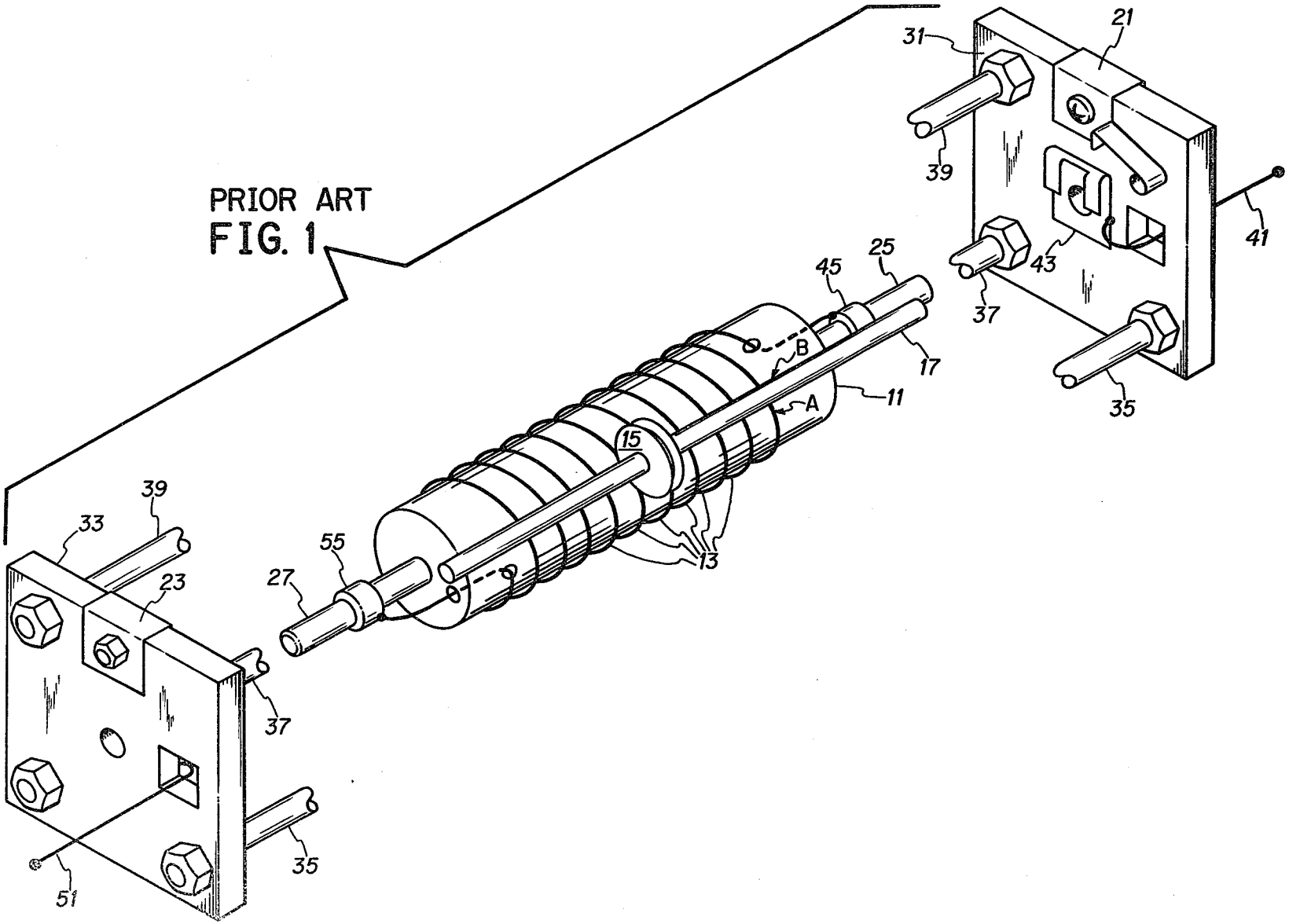
PRIOR ART FIG. 1
FIG. 1 is an exploded perspective view representing a prior art roller coil.

Turning now to FIG. 1, the conventional and familiar roller coil represented therein comprises a non-conductive cylindrical form 11 bearing a coil 13 of substantially helically wound bare conductive wire, and further comprises a trolley wheel contactor 15 carried by conductive guide 17. Trolley wheel contactor 15 is grooved or curved around its circumference so as to mate with or receive the coil wire. Guide 17 is held substantially parallel to the side of the coil by conductive spring-suspension mounts 21 and 23 which also serve as electrical terminals. Axially located shafts 25 and 27 protruding from the two form ends are journalled through openings in non-conductive end plates 31 and 33. Rods 35, 37 and 39 secure end plates 31 and 33 together and the secured plates hold the form and coil and allow rotation of the coil about its central axis.

Electrical connection or access to the far end of the coil is via electical wire or terminal 41, brush 43, and slip ring 45. Electrical connection or access to the near end of the coil is via electrical terminal 51, brush 53 (not shown), and slip ring 55. Electrical connection or access to the roller/trolley wheel 15 and the point of the coil it touches its via either of mount-terminals 21 or 23, and via guide bar 17.

Trolley wheel 15 is free to turn about guide 17 and is also free to slide theralong. As the coil is rotated about is axis, the coil acts like a worm or screw and drives the wheel 15 along the guide 17. Thus, a variable inductance is available between either end of the coil and the trolley wheel contactor.

The arcing possibility briefly mentioned hereinabove can arise in the following manner. Assume that terminal 41 (and thus the far end of the coil) is connected to high voltage RF and that the roller/trolley wheel 15 is the low voltage side of the used portion of the coil. As the coil is tuned such that the trolley wheel moves toward the near end, then the voltage differential between the ends of the used coil portion (i.e., between the coil far end and the wheel) increases. Since the guide 17 is at the same potential as the wheel 15, the entire voltage differential appears across the air gap existing between the far end of guide 17 and the coil wire directly underneath. That is, at location A on the coil, the magnitude of the voltage is high and at location B on the guide, the magnitude of the voltage is low. If the voltage between ends of the used coil portion becomes too great, the potential difference between locations A and B can exceed the breakdown voltage of the gap between locations A and B, and arcing occurs.

The resonance problem briefly mentioned hereinabove can arise in the following manner. Assume that terminal 41 (and thus the far end of the coil) is connected to RF and that the roller/trolley wheel 15 is the other side of the used portion of the coil. Further assume that the frequency of the RF is near the high end of an employed frequency range and that only a small part of the electrical coil is used. Since most of the coil is unused in such tuning condition and since, in general, resonant frequency decreases as inductance value increases, the resonant frequency of the unused portion may well be too low to be compatible with the frequency for which the used portion is being used. If the user does not desire to replace the coil with a shorter one (i.e., one which would have less unused portion)

then such user typically would effect a shorting between certain turns of the unused portion to increase the resonant frequencies of the unused portion. Such shorting as mentioned hereinabove can be accomplished in several ways including using temporary quick connection shorting means.

Turning now to FIG. 2, therein is represented apparatus for resolving the aforedescribed problems. The variable inductance apparatus represented in FIG. 2, although in accordance with the principles of the invention, is similar in some respects to the FIG. 1 apparatus and thus in the interest of conciseness, redundant explanation and description will be minimized or avoided where practical. Like designators are employed for like elements in the two figures.

More detailedly now, the FIG. 2 inductance apparatus comprises a rotatable coil 62 and carriage assembly 63. Coil 62 is wound upon a form 59 having end shafts 25 and 27 supported in a frame comprising end plates 31 and 33 and base 32. Coil 62 comprises a conductive electrical coil portion 13 and a non-conductive portion 64. Portion 13 is basically the same as coil 13 of the FIG. 1 apparatus and serves both as an electrical coil and as a mechanical worm. Non-conductive portion 64 serves as a mechanical worm extension of the portion 13 and follows a helical path substantially like the path of coil portion 13. The near electrical end of coil 13 passes through an opening to the inside of form 59 and the wire is extended therein so as to exit the form and connect to slip ring 55 (not shown in FIG. 2). The far end or beginning of non-conductive coil portion 64 is located adjacent the near end of the conductive coil portion 13, i.e., is located near the form opening where the conductor passes to the inside of the form. The adjacent ends of the two coil portions are sufficiently adjacent that the trolley wheels move smoothly from one "track" to the other. In this sense, the trolley wheels maintain their continuous contact with the coil 62 even as they make the transition between coil portion 64 and coil portion 13.

Carriage assembly 63 comprises four conductive trolley wheel contactors 71, 72, 73, 74, four non-conductive trolley wheels 76, 77, 78, 79, four conductive axles 81, 82, 83, 84, and two axle retainer plates 86 and 87. All eight trolley wheels are held in contact with and in distribution around coil 62 by the wheel support system comprising the axles, the axle retainer plate, and a further retention and suspension system shown in FIG. 3. Still referring to FIG. 2 for the time being, each of the four axles runs substantially parallel to the side of the coil, the near ends of the four axles being journaled through radially extended cutouts in retainer plate 86, and the far ends of the four axles being journaled through radially extended cutouts in retainer plate 87. Each axle carries a conductive wheel and a non-conductive wheel, the non-conductive wheel providing improved dynamics, balancing, and suspension. Each of the non-conductive wheels is located along its axle so as to substantially complement the position of the conductive wheel along the same axle. Non-conductive wheel 79, not shown in FIG. 2, is located toward the far end of axle 84. All eight trolley wheels are grooved around their circumference so as to be suitable for receiving and riding along the track of the worm.

As represented in FIG. 3, the axles are secured to the retaining plates by means such as retaining clips 92 which prevent relative longitudinal movement between the axles and the retaining plates. (Only one clip is shown but is typical of the sixteen clips employed, i.e., four per axle.) A continuous flexible band such as an "O" ring 94 is stretched around the near ends of the four axles, and a second similar flexible band (not shown) is stretched around the far ends of the four axles, thus ensuring that the eight wheels maintain continuous contact with the coil 62.

Notches along the bottom of plates 86 and 87 mate with and receive rail 96 located on base 32. Rail 96 has a conductive portion 96C and a non-conductive portion 96N and serves mechanically as a stop which prevents rotation of the carriage assembly 63 about the worm. The rail 96 is suitable for accommodating sliding motion of the carriage assembly therealong and comprises a non-conductive material plated with copper over about half its length.

Conductive axles 81, 82, 83, and 84 are electrically connected together with connection 98 which further connects the axles to brush 99. Due to the various electrical contacts or connections, there is electrical continuity between each of conductive wheels 71, 72, 73, 74 and terminal 100.

For the FIG. 2 apparatus to have the same inductance range as the FIG. 1 apparatus, the coil form 59 is elongated relative to its FIG. 1 counterpart so as to accommodate the added non-conductive coil portion 64.

As the coil 62 is rotated, it acts like a worm or screw to drive the entire carriage assembly 63 axially along the worm. Conductive trolley wheel contactors 71, 72, 73, and 74 and their respective axles travel substantially parallel to the side of the coil 62. As the conductive trolley wheels travel along their paths, each continuously contacts the coil 62 and contacts only one turn at a time. As indicated in FIG. 2, each of the conductive trolley wheels is narrow enough such that it will not simultaneously contact two adjacent coil turns. Also, electrical contact is maintained between brush 99 and conductive rail portion 96C as the carriage assembly 63 travels along the worm. Thus, electrical continuity is maintained between each of the conductive wheels and the terminal 100 as the carriage assembly moves. Each conductive wheel serves as a moveable contactor, conductive rail portion 96C serves as an electrical contact positioned remote from the far end of the coil 13, and the four axles plus connection 98 plus brush 99 together serve as a moveable connecting means electrically interconnecting the wheels and conductive rail portion 96C.

The position of each conductive wheel contactor relative to the other three is maintained throughout the tuning range because all conductive wheels are always in contact with some part, either conductive or non-conductive of the worm. The four conductive wheel contactors are spaced relative to one another to ensure that the unused inductor resonant frequencies are always higher than the frequency of operation. As the electrical coil portion 13 is tuned so that most of the coil 13 is used, the shorting contactors 72, 73 and 74 are stored on the non-conductive portion 64 of the total coil 62. These contactors move normally onto the non-conductive portion. In doing this, they retain their relative mechanical position to the active contactors when returned to the coil active circuit. Thus the non-conductive portion 64 acts as a "sidetrack" and serves to provide contactor position memory and storage.

In a tuning condition such as one represented by the schematic of FIG. 4*a*, where most of the coil portion 13 is unused, all four conductive wheels simultaneously contact conductive portion 13, and thus a short is impressed across the turns between wheels 71 and 72, and a short is also impressed across the turns between wheels 72 and 73, and a short is also impressed across the turns between wheels 73 and 74. In an intermediate tuning condition such as that represented by the schematic of FIG. 4*b* where approximately half of the coil portion 13 is unused, the conductive wheel contactors 73 and 74 may have traveled off the conductive worm portion onto the non-conductive worm portion while the conductive wheel contactors 71 and 72 remain in contact with the conductive portion, whereby a short is impressed across the conductive turns between wheel 71 and wheel 72. In a tuning condition such as that represented by the schematic of FIG. 4*c* where very little of the coil portion 13 is unused, all three wheel contactors 72, 73 and 74 may have traveled off the conductive worm portion onto the non-conductive portion leaving only the wheel contactor 71 in contact with the conductive portion, whereby no shorting of unused conductive turns is effected.

It should also be noted that the FIG. 2 apparatus also resolves the abovedescribed arcing problem associated with the prior art. More particularly, and referring simultaneously to FIGS. 2 and 4*a, b*, and *c*, assume that terminal 41 (and thus the right-hand end of coil 13) is connected to high voltage RF, and that the conductive contactor wheel 71 is the low voltage side of the used coil portion. In the tuning condition exemplified either by FIGS. 4*b* or 4*c*, the voltage differential between contactor wheel 71 and the right-hand end of coil 13 may be substantial. However, as should be apparent from FIGS. 2, 4*a*, 4*b*, and 4*c*, the points which share the low voltage potential are not located near the high voltage coil end. Since there is no low voltage point spatially located near the high voltage end of the coil, the arcing problem associated with certain prior embodiments is overcome.

In addition, use of a shorting connection such as 105 between terminal 100 and terminal 51 is preferred because it guarantees the voltage at the end of the conductive coil portion 13 is always the same as the voltage of roller contacts 71–74. This ensures there is no arcing when any conductive roller rolls off the end of the conductive portion 13 onto the non-conductive portion 64. The termination also provides the unused portion resonance short between the end of coil conductive portion 13 and: in FIG. 4*a*, roller 74; in FIG. 4*b*, roller 72; in FIG. 4*c*, roller 71.

Typical of the threadlike filament material useable for providing the non-conductive coil portion 65 is a nylon mono filament material. Such material is non-conductive and has dimensions similar to conductive coil wire and may be wound on the form much like wire.

In some embodiments, it may be desirable to have a number of conductive trolley wheel contactors which is different from the four conductive contactor arrangement of the presently preferred embodiment. It should be noted however that it is preferred that the number of wheels per axle be limited to two in order to ensure that all of the wheels remain in contact with the coil 62 at all times. It of course will be appreciated that the non-conductive coil portion 64 could comprise something other than the non-conductive filament wound upon the form 59. For instance, coil portion 64 could comprise ribs molded into the form 59 according to a substantially helical path and formed in dimension suitable for accommodating the trolley wheels and presenting the wheels a track continuation or "sidetrack".

Thus, while various embodiments of the present invention have been shown and/or described, it is apparent that changes and modifications may be made therein without departing from the invention in its broader aspects. The aim of the appended claims, therefore, is to cover all such changes and modifications as fall within the true spirit and scope of the invention.

What is claimed is:

1. A variable inductor comprising:

rotatable, substantially helical coil means comprising multiple turns of electrical conductor, said multiple turns of electrical conductor having a first end and a second end;

electrically conductive contact means being situated remote from said first end;

a carriage means for being driven by and traveling along said coil means as said coil means is rotated;

said carriage means including (i) a plurality of trolley wheels and (ii) support means for holding said wheels in contact with and in a distribution around the coil means, at least one of said trolley wheels being electrically conductive and affording electrical contact with the electrical conductor;

said carriage means further including electrical connection means for electrically interconnecting said conductive wheel and said remotely situated electrically conductive contact means, said electrical connection means traveling simultaneously with the carriage means and so that as the trolley wheel travels away from the first end said electrical connection means also travels away from the first end.

2. A variable inductor as defined in claim 1 wherein said multiple turns of electrical conductor is a first coil portion, and wherein said coil means further includes a second coil portion, said first and second coil portions being situated substantially end to end, said second coil portion comprising an electrically non-conductive extension of said first coil portion such that said first and second coil portions together serve substantially as a mechanical worm;

and wherein at least a second one of said plurality of trolley wheels is electrically conductive and capable of affording electrical contact with the first coil portion;

the first and second electrically conductive trolley wheels being situated relative to one another such that in a first tuning condition, the two conductive wheels may simultaneously contact the first coil portion, and such that in a second tuning condition one of the two conductive wheels may contact the first coil portion while the other contacts the second coil portion.

3. A variable inductor as defined in claim 2 and further including means for electrically shorting together the first and second conductive wheels.

4. A variable inductor as defined in claim 3 and further including means for electrically shorting together (i) the second end of said first coil portion and (ii) the remotely situated electrically conductive contact means.

5. A variable inductor as defined in claim 1 and further including a coil form, and wherein said second coil portion comprises a non-conductive filament wound upon said form.

* * * * *